United States Patent [19]

Hill et al.

[11] 4,123,930

[45] Nov. 7, 1978

[54] MANDREL FOR BENDING TUBES

[75] Inventors: Ernest W. Hill, Aurora; Dale E. Maier; Melvin R. Humphrey, both of Evergreen, all of Colo.

[73] Assignee: Teledyne Industries, Inc., Los Angeles, Calif.

[21] Appl. No.: 853,294

[22] Filed: Nov. 21, 1977

Related U.S. Application Data

[63] Continuation-in-part of Ser. No. 782,539, Mar. 29, 1977, abandoned.

[51] Int. Cl.[2] ..... B21D 9/03

[52] U.S. Cl. ..... 72/466

[58] Field of Search ..... 72/466, 150

[56] References Cited

U.S. PATENT DOCUMENTS

| | | | |
|---|---|---|---|
| 1,683,573 | 9/1928 | Mueller et al. | 72/466 |
| 1,978,452 | 10/1934 | Flodin | 72/466 |
| 2,776,697 | 1/1957 | Zerlaut | 72/466 |
| 3,190,106 | 6/1965 | Spates | 72/466 |
| 3,286,503 | 11/1966 | Garrett | 72/466 |
| 3,315,516 | 4/1967 | Sassak | 72/466 |
| 3,408,850 | 11/1968 | Maier et al. | 72/466 |
| 3,415,107 | 12/1968 | Ruscitti | 72/466 |
| 3,455,142 | 7/1969 | Roberts | 72/466 |

*Primary Examiner*—Lowell A. Larson
*Attorney, Agent, or Firm*—Ralph M. Braunstein

[57] ABSTRACT

A flexible mandrel for use in bending tubes and especially for producing tight bends in thin wall, high strength metal tubing. The mandrel comprises a series of ball members each of which is adapted to nest within the preceding ball of the series as the mandrel is flexed. The balls are free to rotate transversely and to slide longitudinally on a series of rigid link members which are flexibly interconnected. The balls and links are so constructed that as the mandrel is flexed, each ball pivots around a point located at or near the geometrical center of its outer curved surface.

8 Claims, 3 Drawing Figures

MANDREL FOR BENDING TUBES

This is a continuation in part of our co-pending application Ser. No. 782,539, filed Mar. 29, 1977, now abandoned.

BACKGROUND OF THE INVENTION

Flexible mandrels have long been used to support the walls of metal tubing as it is bent. Such mandrels generally consist of a rigid mandrel body and a series of ball or ring members, each of which is locked on to a rigid inner ball link. The links are flexibly interconnected so that the string of balls may flex during the bending or forming process. Tube bending mandrels of this type are disclosed, for example, in U.S. Pat. No. 3,190,106, issued June 22, 1965, to H. M. Spates and have performed well in bending tubing of many different sizes of materials. The routine availability of mandrels for a wide variety of tube bending operations with ordinary tubing materials has naturally stimulated interest in extending the limits of these techniques to include the production of so-called "difficult" bends, e.g., those involving tight radii, compound bends, and bends in large diameter or thin walled tubes of the more exotic high strength metals and alloys. Requirements for bends of a difficult nature presently originate most often in the aero-space industry, but many other uses of such tubing may develop when the technology of producing the difficult bends becomes reliable.

Among the problems encountered in the use of conventional and prior art mandrels to produce tight bends or bends in thin walled exotic metal tubing is the high rate of wear and breakage of the mandrel links due to the extremely large and concentrated mechanical stresses imposed on them during the bending operation. Attempts to alleviate these problems by enlarging the parts for greater strength conflict with the need to keep the linkages small in order to provide close-spaced support for the walls of the tubes being bent, and to permit the mandrels to be flexed into tight radius curves. One type of prior art device used to form difficult bends in ordinary or "soft" metal tubing is the cable mandrel, in which the flexible chain of rigid ball links is replaced by a high strength flexible steel cable held taut between the mandrel body and a special terminal link at the free end of the mandrel. A close pitch or spacing of the balls in the cable mandrel is achieved by using a so-called "reverse ball" configuration in which each ball is designed to fit or nest inside the preceding ball as the string of balls is flexed, instead of riding on the outer surface of the preceding ball as in the more conventional rigid link mandrel.

While cable mandrels have been used to produce bends not otherwise feasible, they suffer a number of drawbacks which prevent their routine application in high volume production situations. Most of these limitations are directly attributable to the characteristics of the wire cables used to link the mandrel balls. For instance, the elastic characteristics of a wire cable are determined by the properties of the filaments and strands of which it is constructed, and these properties exhibit a statistical dispersion. As a result, a considerable portion of the cable's potential strength is unused under most conditions, while the load is very high on those elements which normally carry it. It is not surprising, therefore, that cables tend to stretch and to break, requiring periodic adjustment and replacement. Moreover, cables have relatively low transverse strength and are subject to shearing over the inner surfaces of the ball members which they contact while under the heaviest loads during tube bending operations. The more or less continuous need for time consuming adjustment and replacement of cables makes these mandrels costly to use and has substantially limited their application. And, of course, the limitations of the cables are most dramatic when the tubes to be bent or the bends to be performed are in the "difficult" category.

SUMMARY OF THE INVENTION

We have invented a very strong tube bending mandrel having a close pitch and capable of performing tight bends in thin walled high strength tubing, without stretching or frequent breakage. Our invention is, moreover, easily serviced when required, in that worn or damaged parts of the mandrel are readily replaced, with reassembly and readjustment being simple operations involving a minimal number of steps.

Our invention comprises a mandrel having a rigid body section and a series of spherical ball or ring members which are free to float or slide longitudinally and rotate transversely on a chain of flexibly interconnected rigid link members. The ball members, in the preferred embodiment, are of the "reverse" or internally nesting type to provide closeness of pitch and to distribute the mechanical stress of the bending operation along the series of balls instead of concentrating it on the balls and links immediately within the portion of the tube undergoing deformation. Each ball member has corresponding outer and inner spherical surface portions. The centers of curvature of the spherical surfaces are longitudinally spaced apart by a distance equal to the pitch defined by the spacing between the rotational centers of the link members. In the assembled mandrel, each ball member, together with the link member on which it is carried, is pivotable about a point which coincides substantially with the center of curvature of the outer spherical surface of the ball member.

The objects and advantages of the invention may be thoroughly understood from the following more detailed description taken in conjunction with the accompanying drawing.

DETAILED DESCRIPTION OF THE PREFERRED EMBODIMENT

Figures 1, 2, 3:
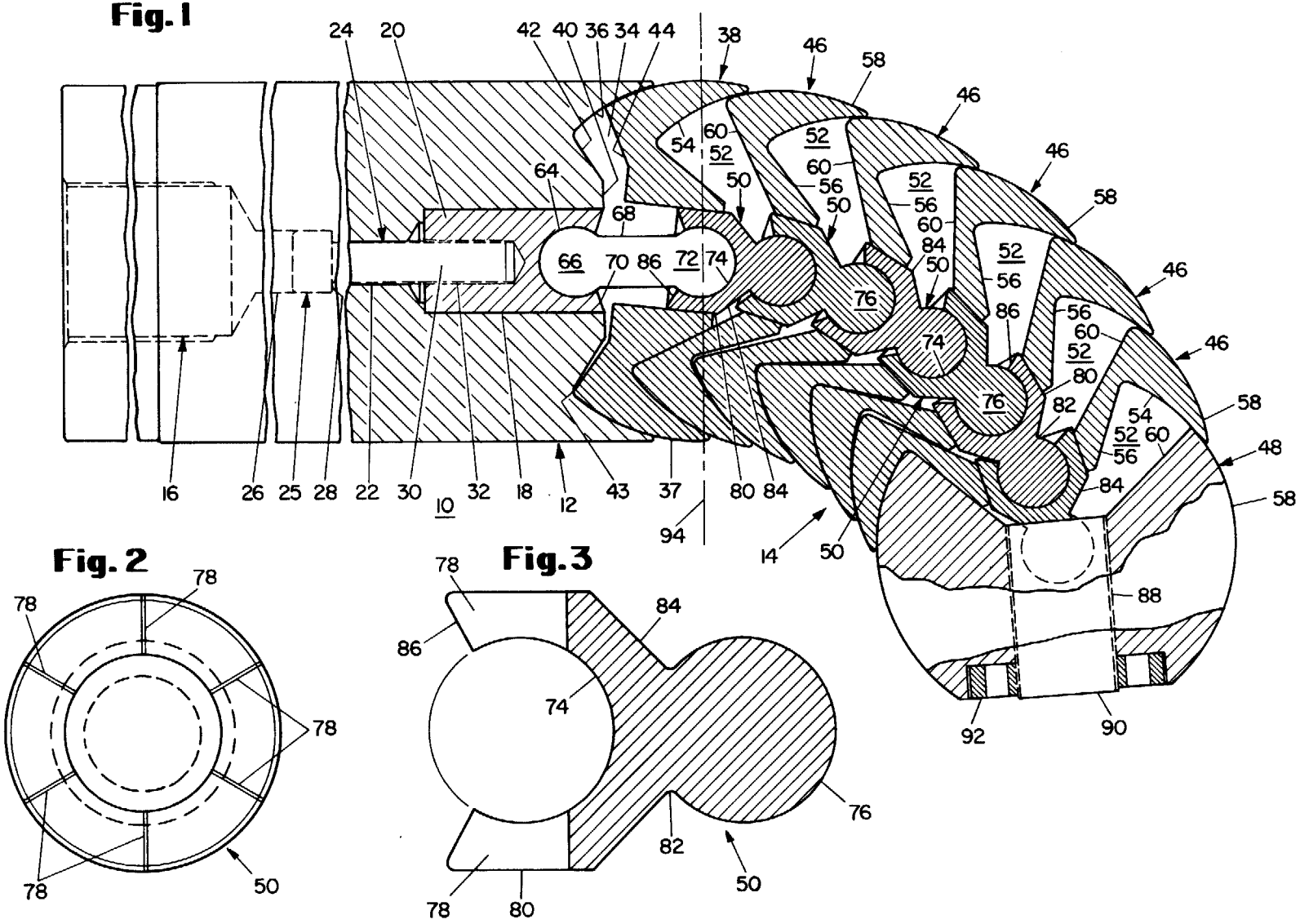
FIG. 1 is an elevational view, partly in cross-section, of a tube bending mandrel embodying the invention.
FIG. 2 is an end view of a link member employed in the mandrel shown in FIG. 1.
FIG. 3 is a side sectional view of a link member as shown in FIG. 2.

The tube bending mandrel 10 shown in FIG. 1 is an illustrative embodiment of the principles of the invention and represents a presently preferred mode of realizing the benefits of our discovery. Mandrel 10 comprises a straight and rigid cylindrical mandrel body 12 and a flexible ball-and-link section 14. Mandrel body 12 has at its free end a threaded coaxial hole 16 which is adapted to receive a stem (not shown) by which mandrel 10 may be connected to a tube bending machine of appropriate design. The opposite or leading end of mandrel body 12 is provided with a smooth coaxial hole 18 which is adapted to receive a mandrel link 20 described in detail hereafter. A smooth coaxial hole 22 having a somewhat smaller diameter than either of holes 16 or 18 extends between their bottoms and is adapted to pass the shank of a socket head cap screw 24 by which mandrel link 20 is retained in hole 18. Hole 22 has a larger diameter portion 26 at its end toward the free end of body 12 to accommodate the head of cap screw 24, and a shoulder 28 at the transition between the larger and smaller diameters provides a surface against which the head 25 of screw 24 may be drawn tight as its threaded shank 30 engages a correspondingly threaded hole 32 in mandrel link 20. The leading end of mandrel body 12 is formed with an annular recess 34 having an inwardly flared spherically curved side-wall 36 adapted to mate slidingly with the spherical outer surface 37 of the initial mandrel ball member 38 of flexible link section 14. The bottom surface of recess 34 has, in the illustrative embodiment 10 of FIG. 1, a flat surface portion 40 surrounding the opening of hole 18, and an outwardly flared surface portion 42 which effects the transition between flat surface 40 and inwardly flared surface 36. The two oppositely flared surfaces 36 and 40 intersect to form the deepest portion 43 of recess 34 which is shaped to receive a correspondingly shaped rear surface 44 of initial or mandrel ball 38.

Flexible link section 14 of mandrel 10 comprises a series of spherically surfaced mandrel ball members 38, 46 and 48, the outer surfaces of which are adapted to support the walls of a tube during a bending or forming operation, and a corresponding series of flexibly interconnected rigid ball link members 50. The initial ball member 38 of the series has a rear surface 44 which is generally adapted to fit the bottom surface 40, 42 of recess 34 in the leading end of mandrel body 12 when flexible section 14 is bent to its maximum extent as illustrated in FIG. 1. The leading end of each of mandrel balls 38, 46 and 48 is provided with a recess similar in form and function to that of recess 34. In particular, the leading end of each ball 38, 46 and 48 has a recess 52 defined by an inwardly flared spherically curved surface portion 54 and outwardly flared conical surface portion 56. The inwardly flared surfaces 54 are each adapted to mate slidingly with the outer surfaces 58 of the mandrel ball immediately next in the series of balls on flexible link section 14 of mandrel 10. Outwardly flared surfaces 56 are each adapted to fit against the correspondingly shaped rear surface 60 of the next ball member in the series when flexible link section 14 is bent to its maximum extent.

The series of ball members 38, 46, 58 is held together by a series of flexibly interconnected rigid link members comprising mandrel link 20, master link 68, ball links 50, and terminal link 90. Mandrel link 20 comprises a cylindrical body adapted to fit slideably in hole 18 in the leading end of mandrel body 12, with its leading end flush with the flat annular surface 40. A threaded hole 32 in the rear end of mandrel link 20 is adapted to receive the threaded end 30 of cap screw 24 which, when drawn tight, holds flexible link section 14 together with mandrel body 12. The leading end of mandrel link 20 is formed to provide a partially open spherical recess or socket 64 adapted to receive a spherical enlarged end 66 of a dub-bell shaped master link 68. Socket 64 is surrounded by an inwardly flared annular surface 70.

Master link 68 has a second spherical enlargement 72 at its leading end, which is adpated to fit within a corresponding spherical socket 74. Each of the ball links 50 has a similar spherical socket 74 at its rear end, and a corresponding spherical enlargement 76 at its leading end, by which means the entire series of individual rigid links may be flexibly interconnected. The body portion 80 of each link surrounding the spherical socket recess is divided by slots 78, as illustrated in FIGS. 2 and 3, to provide sufficient flexibility for the spherical ends 76 of the adjoining links to be inserted and removed, poppet style. The sockets are prevented from expanding in use by the strength of the surrounding ball members, so that a flexible and very strong chain of links is formed. The outside surface of body portion 80 of each link 50 is cylindrical and is adapted to mate slideably with the inside surfaces of corresponding cylindrical holes in the ball members 38, 46. The transition from the relatively large outside diameter of body portion 80 to the relatively small diameter of the neck 82 is accomplished by an outwardly flared surface 84. The angle of surface 84, together with the angle of the inwardly flared annular surface 86, is adapted to permit each link 50 to swivel freely at least to the extent of the bending permitted by the nesting surfaces of the ball members 38, 46, 48.

Terminal ball 48 at the free end of mandrel 10 has a threaded central hole 88 adapted to receive a threaded terminal link 90 which has a socket compared in form and function to the sockets of links 50, previously described. A lock nut 92 is provided to be screwed over the leading end of terminal link 90, and is recessed in the end of terminal ball 48.

In accordance with our invention, the centers of curvature of outer and inner spherical surfaces 58 and 54 are axially spaced apart by a distance equal to the pitch defined by the spacing between the centers of the ball and socket portions 74, 76 of the ball links 50. The length of master link 68 is selected so that the center of spherically enlarged end portion 72 is located substantially at the center of curvature of spherical surface 36 of mandrel body 12. As a consequence of these relationships, the centers of curvature of the outer spherical surfaces of adjacent mandrel balls in assembled flexible link section 14 are axially spaced apart by the distance defined as the pitch, and the center of curvature of the outer surface of each ball coincides with the center of the socket portion 74 of the link 50 on which it rides, which is also the center of the ball end 76, 72 of the preciding link in the series. Moreover, the center of curvature of the inner spherical surface 54 of each ball 46 coincides with the center of the ball end 76 of the link 50 on which it rides, which is also the center of the socket portion 74 of the succeeding link in the series. As a result, when flexible link section 14 is flexed, the outer spherical surface 58 of each ball member 46 rotates about its own center of curvature.

A mandrel of the type described herein to illustrate the invention may be assembled by inserting end of master link 68 into the socket 64 or mandrel link 20, which is then inserted into the hole 18 of mandrel body 12 and engaged by cap screw 24. Ball links 50 are then interconnected by inserting each spherical end into the socket of the adjoining link, and the series of links is attached to the mandrel by inserting the leading end 72 of master link 68 into the socket 74 of the initial link 50. Ball members, beginning with mandrel ball 38 and following with the appropriate number of intermediate balls 46 are next slid over the interconnected series of links 50. Finally, terminal link 90 is swivelly joined to the spherical end of the last link 50 of the series, terminal ball member 48 is screwed onto the threaded outer surface of terminal link 90, and lock nut 92 is applied to complete the assembly.

In a tube bending mandrel embodying the invention, such as mandrel 10 depicted in FIG. 1, the reverse or nesting configuration of the balls permits the pitch or spacing between centers of rotation of adjoining links to be shorter than in the more customary or normal configurations. Also, the outer surface of the flexible link section 14 of the mandrel 10 is substantially continuous rather than presenting the gaps found in mandrels of the more normal type. Thus, the wall of a tube undergoing bending is more uniformly supported during the process, and a smoother bend is produced.

Because the ball members 46 swivel about the centers of curvature of their outer spherical surfaces 58 as the flexible link section 14 is flexed, the principal forces acting as the surfaces 58 during tube bending operations are directed radially and normal to the surfaces. This reduces the frictional wearing of the balls and prolongs their useful lives, further reducing maintenance time and improving the economic factors associated with the use of mandrels embodying our invention. Another advantage of the preferred embodiment follows from the fact that the initial or mandrel ball 38 swivels about the center of the socket 74 of initial link 50 instead of about a point within the mandrel body 12 as in more conventional designs. As a result, the point on the mandrel which must be tangent to the bend die of the bending machine lies on line 94 in front of the mandrel body. Because line 94 extends through the moveable initial ball 38, positioning of the mandrel body with respect to the point of tangency of the bend die may be within a relatively broad range rather than being critically restricted as with other designs. The reduction of criticality makes adjustment easier and reduces the likelihood of breakage or accelerated wear due to improper adjustments.

It is characteristic of mandrels embodying the invention that the balls — with the exception, of course, of the terminal ball — slide freely on the links. Moreover, in the case of spherically shaped balls for use in bending tubes of circular cross-section, each ball is also free to rotate in a plane transverse to the link on which it floats. The rotational freedom serves to distribute wear more or less evenly over the surface of the balls. The freedom of the balls to slide on the links causes the position of the balls to be controlled by the forces transmitted directly through the sliding contact of adjoining balls instead of through the links as in conventional mandrels. Since the transverse shear type forces of bending are transmitted through the balls, and the links carry chiefly longidudinal tension loads, the links may be made smaller than in previous mandrels and thereby permit closer pitches and tighter bends. And, since the bending forces are spread over the larger and stronger peripherial portions of the balls, the overall structure of the mandrel is more resistant to the loads imposed in use. It will also be appreciated that replacement of worn parts is simpler in our floating ball mandrel than in those wherein the balls are attached to corresponding links. Thus, to replace a worn ball, it is necessary only to remove the lock nut, terminal link and terminal ball. The remaining balls may then be slid off without disassembling the links, the worn ball removed and all of the balls replaced back onto the still intact chain of links.

Those skilled in the tube bending art will recognize that many variations and modifications of our invention are possible and may be made without departing from its scope and spirit. As one example, while the preferred embodiment has been described with reference to a mandrel for bending tubes of circular cross-section, the sample principles may also be applied to mandrels of bending tubes of other cross-section. Other possibilities will be apparent and should be considered within the scope of the claims.

What is claimed is:

1. Tube bending mandrel having a flexible link section comprising:

a series of rigid link members flexibly interconnected in end-to-end relation, each of the link members having a spherically curved ball at one end and a cylindrical body portion with a corresponding spherically curved socket at the other end, the centers of curvature of the ball end and the socket end being spaced apart by a predetermined distance; and a corresponding series of ball members fitting on and slideable over the cylindrical body portions of the link members, each ball member having inner and outer spherically curved surfaces with centers of curvature spaced apart by the said predetermined distance, the outer spherically curved surface of each ball member nesting slideably within the inner spherically curved surface of the preceding ball member and the inner spherically curved surface of each ball member fitting slideably over the outer spherical surface of the succeeding ball member in the series, each ball member being positioned on the cylindrical body of its corresponding link member with the center of curvature of its outer spherical surface substantially coincident with the center of curvature of the spherically curved socket of the link and with the center of curvature of the spherically curved ball end of the preceding link member positioned therein.

2. Tube bending mandrel as in claim 1 and further comprising means at the leading end of the flexible link section for retaining the series of ball members on the series of link members in close-fitting serially nested relation.

3. Tube bending mandrel as claimed in claim 2 and further comprising:

a mandrel body having at its leading end a recess with an inner spherically curved surface adapted to fit slideably over the outer spherically curved surface of the initial ball member in the series, and means for flexibly interconnecting the mandrel body and the flexible link section with the center of curvature of the spherically curved surface of the initial ball member coincident with that of the inner spherically curved surface of the end of the mandrel body.

4. Tube bending mandrel as claimed in claim 2 wherein the retaining means at the end of the flexible link section comprises:

a terminal link member flexibly interconnected in end-to-end relation with the preceding link member of the series, a terminal ball member having an outer surface portion nesting slideably with an inner surface of the preceding ball member of the series, and means for locking the terminal ball member on the terminal link member.

5. Tube bending mandrel as claimed in claim 3 wherein the means for flexibly interconnecting the mandrel body and the flexible link section comprises:

a mandrel link having a body with a spherically curved socket portion at one end, a recess in the leading end of the mandrel body and adapted to receive the body of the mandrel link, a master link having at one end a spherically curved ball portion adapted to be held in the socket portion of the mandrel link, and at the opposite end a ball portion adapted to be held in the socket portion of the initial link member of the series, and means for retaining the mandrel link in the recess in the leading end of the mandrel body.

6. Tube bending mandrel as claimed in claim 4 wherein the terminal link member has an externally threaded cylindrical body, the terminal ball member has a corresponding internally threaded hole, and the terminal ball member is screwed on to the terminal link member with a portion of the threaded body of the link extending beyond the hole in the ball, and further comprising a lock nut screwed on the threaded portion of the link member extending beyond the ball member.

7. Tube bending mandrel as claimed in claim 1 wherein the walls of the socket portions of the link members are slotted to provide flexibility sufficient to enable the ball portions of the preceding link members to be inserted therein.

8. Tube bending mandrel as claimed in claim 1 wherein the cylindrical body portion of the link members has a circular cross-section and each ball member is free to rotate on its corresponding link member in a plane transverse to the axis thereof.

* * * * *